US005514393A

United States Patent [19]

Lynch et al.

[11] Patent Number: 5,514,393

[45] Date of Patent: May 7, 1996

[54] PRESSURIZED BEVERAGE PACKAGE HAVING AN INTERIOR CHAMBER FOR THE PRODUCTION OF FOAM ON OPENING THE PACKAGE

[75] Inventors: Francis J. Lynch, Dublin, Ireland; Robert Purdham, West Hendon; Derek C. Lockington, Oakham, both of Great Britain

[73] Assignee: Guinness Brewing Worldwide Limited, London, Great Britain

[21] Appl. No.: 146,231

[22] Filed: Nov. 1, 1993

[30] Foreign Application Priority Data

Nov. 10, 1992 [GB] United Kingdom ..... 9223517

[51] Int. Cl.[6] ..... B65B 31/00; B65B 17/00; B65B 25/00

[52] U.S. Cl. ..... 426/112; 426/115; 426/124; 426/131; 426/132; 206/222; 220/501; 220/553

[58] Field of Search ..... 426/112, 115, 426/124, 131, 106, 397, 398, 394, 474, 477, 132; 53/420, 432, 433, 471, 474; 206/222; 220/501, 553

[56] References Cited

U.S. PATENT DOCUMENTS 5,196,216 3/1993 Lynch et al. ..... 426/112

*Primary Examiner*—Donald E. Czaja
*Assistant Examiner*—Curtis E. Sherrer
*Attorney, Agent, or Firm*—McCormick, Paulding & Huber

[57] ABSTRACT

A beverage package has a can 1 within a primary chamber 5 to which is located an insert 6 having a secondary chamber 10. The insert has a bore 11 within which is received a lower end of a capilliary tube 15. The can 1 contains beverage such as beer 20 having gas in solution and sealed to form a headspace 21 containing gas at a pressure greater than atmospheric. The tube 15 contains beverage and its upper end opens into the headspace 21. The secondary chamber 10 contains gas at a pressure greater than atmospheric and on opening of the container the headspace 21 de-pressurises causing beverage and/or gas from the chamber 10 to displace beverage through the restriction of the capilliary tube 15 directly into the headspace 21 causing froth to develop in the headspace.

9 Claims, 2 Drawing Sheets

PRESSURIZED BEVERAGE PACKAGE HAVING AN INTERIOR CHAMBER FOR THE PRODUCTION OF FOAM ON OPENING THE PACKAGE

BACKGROUND OF THE INVENTION

Field of the Invention

The present invention relates to a beverage package. More particularly it concerns beverages containing gas, such as carbon dioxide and/or nitrogen, in solution and packaged in a sealed container which, when opened for dispensing or consumption, causes gas to be evolved or liberated from beverage to form, or assist in the formation of, a head of froth on the beverage. The beverages to which the invention relates may be alcoholic or non-alcoholic; primarily the invention was developed for fermented beverages such as ale, lager, stout or other beer and cider but may be applied with advantage to so-called soft drinks and beverages, or alcoholic drinks such as spirits, liquers, wine and the like.

Beverage packages are known which comprise a sealed container having a primary chamber containing the beverage having gas in solution and forming a primary headspace comprising gas at a pressure greater than atmospheric and in which a secondary chamber containing gas at a pressure greater than atmospheric has a restricted orifice which communicates with the beverage in the primary chamber. Upon opening the package to dispense the beverage, the primary headspace is opened to atmospheric pressure and this creates a pressure differential within the container which causes gas and/or beverage in the secondary chamber to be ejected by way of the restricted orifice into the beverage in the primary chamber. The ejection of the gas or beverage from the secondary chamber and through the restricted orifice causes gas in solution in the beverage to be evolved for froth formation. Examples of beverage packages having the latter characteristics are disclosed in our U.S. Pat. No. 4,832,968 (where it is preferred that beverage is ejected from the secondary chamber for the purposes of froth development) and our own prior package where gas is ejected from a secondary chamber, possibly through a non-return valve, for the purposes of froth development.

Our aforementioned prior Patent discusses the manner in which it is believed that gas in solution in the beverage is caused to be evolved to develop a desirable head of froth on the beverage by the ejection of gas and/or liquid from the secondary chamber through the restricted orifice. This technique for froth development is now well known in the art.

In the known beverage packages of the kind discussed above the restricted orifice is located at or towards the bottom of the beverage in the primary chamber. When the package is opened and gas and/or liquid/beverage is ejected through the restricted orifice, gas in solution is initially evolved in the region of the beverage which is local to the restricted orifice and this evolution of gas develops or grows rapidly to rise throughout the volume of beverage in the primary chamber to develop a head of froth which is retained when the beverage is dispensed from the container. For some beverages, particularly those containing carbon dioxide in solution (with or without nitrogen gas in solution) it is possible for a major part, if not all, of the gas in solution to be evolved from the beverage shortly after the gas or beverage has been ejected from the secondary chamber on opening the package. As a consequence, when the beverage is dispensed from the container into a drinking glass for consumption, it is possible that the absence, or low level, of gas in solution in the beverage will impart undesirable characteristics to the beverage (albeit that such beverage may have a good quality head of froth). This is particularly the case for so-called light beers or lagers where it is preferred that a reasonable volume of gas, usually carbon dioxide, is retained in solution in the beverage as dispensed in a drinking glass so that such gas can evolve naturally to rise as minute bubbles within the beverage and the latter retains a "sparkle" which is considered desirable aesthetically and can add to the consumer's enjoyment and "mouth feel" of the beverage. It is an object of the present invention to provide a beverage package of the kind generally discussed which alleviates the aforementioned disadvantage of excessive liberation of gas in solution so that the beverage when dispensed will retain a desirable "sparkle" without detracting from the desirable characteristics required for froth development in forming a head on the beverage.

SUMMARY OF THE INVENTION

According to the present invention there is provided a beverage package comprising a sealed container having a primary chamber containing beverage having gas in solution therewith and forming a primary headspace comprising gas at a pressure greater than atmospheric; froth developing means comprising beverage having gas in solution therewith and a secondary chamber containing gas at a pressure greater than atmospheric, said beverage of the froth developing means communicating directly with the primary headspace by way of a restriction and said package being openable to open the primary headspace to atmosphere, and wherein the froth developing means is arranged so that said opening of the package creates a pressure differential which causes pressure from gas in the secondary chamber to eject beverage from the froth developing means directly into the primary headspace by way of the restriction and said ejection liberates gas from solution in the ejected beverage to provide froth in the primary headspace.

The beverage of the froth developing means will usually be the same as the beverage in the primary chamber and indeed the beverage for the froth developing means will usually be derived from the beverage in the primary chamber. The volume of beverage of the froth developing means will be relatively small in comparison with the volume of beverage in the primary chamber and when the package is opened to eject the beverage of the froth developing means directly into the primary headspace by way of the restriction, gas in solution in the so-ejected beverage will be liberated as the ejected beverage enters the primary headspace so that the froth which forms in the primary headspace is predominantly developed from the ejected liquid. As a consequence, the beverage in the primary chamber will maintain, or substantially so, its gas, typically carbon dioxide, in solution. It is possible that a negligible amount of gas, particularly carbon dioxide, will be liberated from the beverage in the primary chamber as a consequence of the package being opened and the pressure in the primary chamber reducing to atmospheric pressure but nevertheless it should be ensured that a desirable proportion of gas will be maintained in the beverage in the primary chamber. Therefore when the beverage is dispensed into a drinking glass for consumption, gas may continue to evolve from solution to maintain "sparkle" and other characteristics considered desirable for the beverage product.

The restriction of the froth developing means is preferably in the form of a capilliary passage containing beverage of that means and which passage opens into the primary headspace so that as the beverage is ejected from the capilliary passage by gas pressure from the secondary chamber on opening of the package, gas is liberated from the ejected beverage to form froth in the primary headspace. The liberation of gas from solution in a beverage by directing the beverage through a restriction is well known in the art and is believed to result from a cavitation effect to which the beverage is subjected in passing through the restriction.

The secondary chamber of the froth developing means will usually be located at or towards the bottom of the primary chamber and the aforementioned capilliary passage is conveniently provided by a capilliary tube which extends from the secondary chamber to open into the primary headspace.

Although the secondary chamber may be built-in as an integral part of the container, it is preferred that the secondary chamber is provided within an insert that is located in the primary chamber of the container. Such inserts are now well known in the art and are typically formed as or from plastics moldings which are received within primary chambers of the containers through open tops of the containers and located at a position on or adjacent to the bottom of the respective containers. The insert may be retained in position as an interference fit with the side wall of the container, by suction, magnetically or otherwise.

The aforementioned insert for the secondary chamber may be received within the primary chamber with the secondary chamber sealed and containing gas at a pressure greater than atmospheric and having a closed port through which the secondary chamber is intended, when the package is opened, to communicate with the aforementioned capilliary passage containing beverage. The aforementioned port is maintained closed as the container is charged with its beverage and subsequently sealed. Such inserts are known and generally during processing of the sealed package, for example as a result of the package being heated for pasteurising the beverage, the structure of the insert is modified, for example by thermal distortion of plastics from which it is constituted, to ensure that when the sealed package is opened and the pressure differential applied, communication is effected, possibly by way of a non-return valve in the insert, between the secondary chamber and the capilliary passage of the capilliary tube so that gas pressure from the secondary chamber displaces beverage from and through the restriction of the capilliary passage to eject the beverage into the primary headspace and develop froth. Alternatively, and preferably, the insert is of the kind discussed in our U.S. Pat. No. 4,832,968 which is located in the container with the secondary chamber open to communication with atmosphere by way of a restriction formed by a capilliary passage, conveniently a capilliary tube extending from the insert. With this preferred form of insert, when the primary chamber is charged with beverage and the container sealed with the primary headspace at a pressure greater than atmospheric, beverage from the primary chamber may enter the capilliary passage and the secondary chamber will be pressurised by way of its communication through the capilliary passage with the primary chamber as the contents of the sealed container come into equilibrium. Usually the beverage of the froth developing means, particularly when such means comprises a capilliary passage or tube, will be derived from beverage with which the primary chamber is charged. Usually beverage from the primary chamber will charge the froth developing means during initial filling of the container although charging of the froth developing means with beverage may be achieved subsequent to sealing of the beverage package, for example by inverting or otherwise handling the sealed package. Where the insert is of the aforementioned preferred type, the beverage of the froth developing means may enter the secondary chamber to form a secondary headspace therein containing gas at a pressure greater than atmospheric so that when the package is opened, the pressure differential which develops causes beverage from the secondary chamber to be displaced through the restriction of the capilliary passage into the primary headspace for froth development.

Preferably the froth developing means is arranged so that on opening of the package the beverage which is displaced therefrom into the primary headspace for froth formation is directed towards an upstanding side wall of the container. Such directing of the ejection is conveniently achieved by locating the beverage outlet from the capilliary passage or tube adjacent to the side wall of the container in the primary chamber. By directing the ejection of beverage as aforementioned it is possible to alleviate froth developed from the ejection from being jetted through a top opening of the container.

BRIEF DESCRIPTION OF THE DRAWINGS

Two embodiments of a beverage package constructed in accordance with the present invention will now be described, by way of example only, with reference to the accompanying illustrative drawings, in which.

DESCRIPTION OF THE PREFERRED EMBODIMENTS

Figure 1:
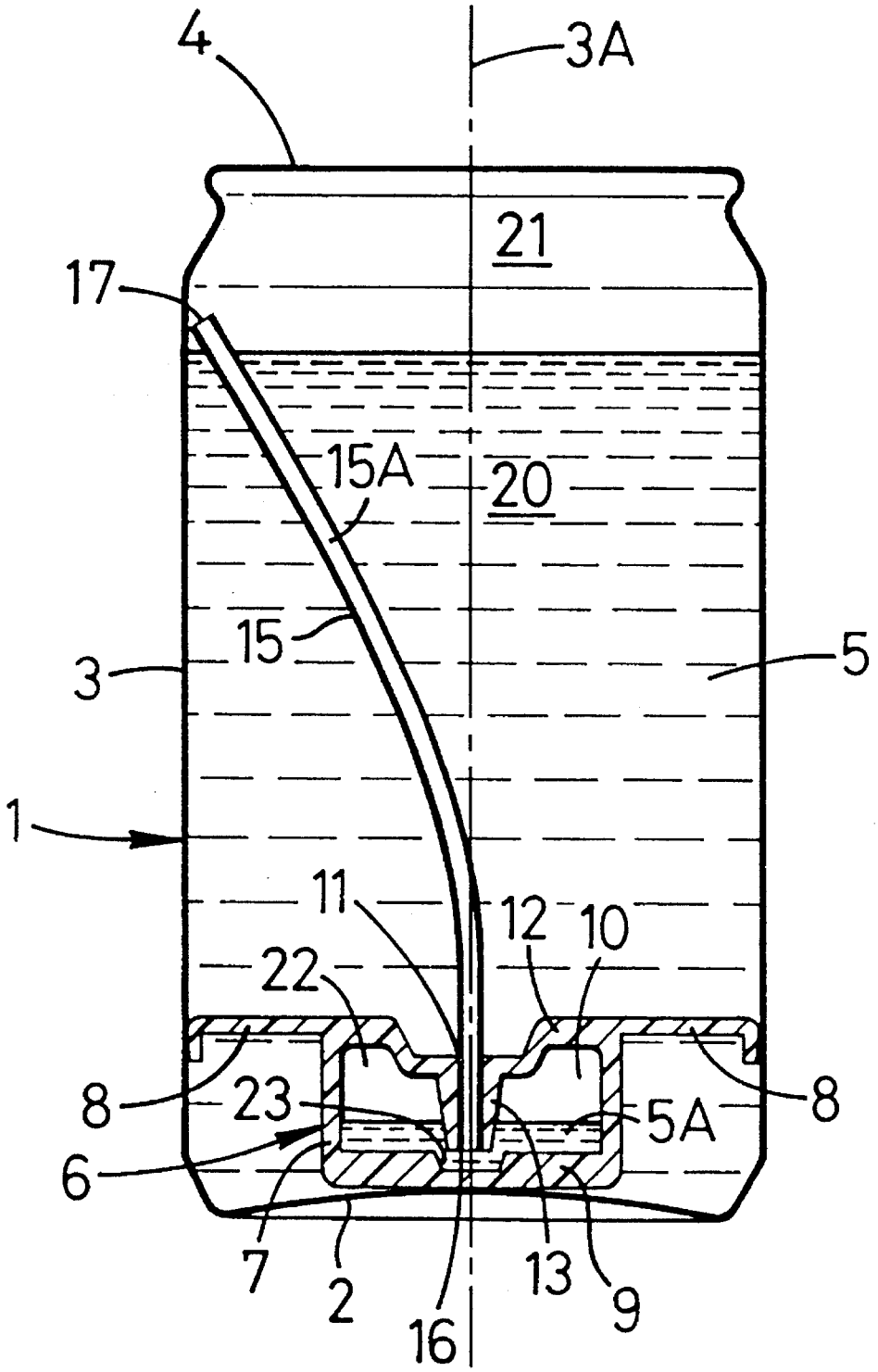
FIG. 1 shows a section through a first embodiment of the package in which a capilliary tube is fitted in a socket seating of a port in an insert forming the secondary chamber from which beverage is ejected.

The beverage packages illustrated comprise a conventional form of container such as a light metal can 1 having an externally concave circular base 2 on which the package will normally stand, a cylindrical side wall 3 and a circular top 4 which will usually be seamed to the side wall 3 to seal the container. The top 4 will be openable, typically by a ring pull, displaceable table or other conventional means for the purpose of dispensing beverage contents of the container.

In the present example the beverage for the package may be considered as a light beer or lager having in solution a mixture of carbon dioxide and nitrogen gases, typically the carbon dioxide content will be 1.25 to 6.0 grammes per liter and the nitrogen gas content will be 3% to 5% vols./vol. The term "vols./vol" is well known in the art but a definition of it may be found in our U.S. Pat. No. 4,279,938.

The container 1 forms a primary chamber 5 and prior to fitting and sealing the top 4 and with the container in an upstanding condition, an insert 6 is inserted into the primary chamber through the open top of the container and located on the base 2 at the bottom of the primary chamber.

The insert 6 is conveniently assembled from plastics moldings to have a hollow generally cylindrical drum 7 from which extend diametrically opposed flanges 8. The insert is fitted within the container so that the flanges 8 frictionally engage with the cylindrical side wall 3 to retain a bottom wall 9 of the hollow drum 7 on the base 2 of the container and position the hollow drum 7 substantially co-axial with the axis 3A of the side wall 3. The hollow drum 7 of the insert forms a secondary chamber 10. In the embodiment of FIG. 1 the secondary chamber 10 of the insert as received by the container communicates with the primary chamber 5 by way of a port 11 in an upper wall 12 of the drum 7. The port 11 is co-axial with the axis 3A and is in the form of a bore extending through a boss 13 that projects from the upper wall 12 of the drum within the secondary chamber 10.

Following fitting of the insert 6 in the open topped container, a plastics tube 15 having a capilliary bore 15A, pre-cut to length, is inserted (by a probe, not shown) through the open top of the container with a bottom end 16 of the capilliary tube moving along the axis 3A so that part length of the tube at its bottom end is received as a press fit and in sealing engagement with the socket which is effectively presented by the bore 11. When fitted to the insert 6, the tube 15 extends within the primary chamber 5 upwardly from the insert towards the open top of the container and so that the upper end 17 of the tube opens into the primary chamber at a considerable distance from the container base 2. It will be seen from the drawing that because the socket 11 is co-axial with the cylindrical wall 3 of the container and the bottom end of the tube 16 is fed into the socket 11 co-axially therewith along the axis 3A, no particular rotational orientation is necessary between the insert 6 and the container side wall to ensure that the socket 11 is appropriately positioned to receive the tube. This is advantageous in a commercial installation where an array of open topped containers are successively fitted with inserts and subsequently tubes fitted successively to the inserts at high speed. Although the bottom end 16 of the tube 15 is fed by the probe into the insert socket 11 along the axis 3A, the tube itself is pre-curved over its length as a shallow arc so that when fitted to the insert the upper end 17 of the tube is located adjacent to and directed towards the side wall 3 as shown in the drawing.

After the tube 15 has been fitted to the insert, the primary chamber 5 is charged with the beverage 20 containing gas in solution and thereafter the container is closed and sealed by the top 4 so that a primary headspace 21 in the primary chamber of the container is at a pressure greater than atmospheric. It will be seen from FIG. 1 that the length of the tube 15 ensures that the upper end 17 of its bore is located in the headspace 21. Pressurisation of the headspace 21 may be achieved in conventional manner, for example by dosing the primary chamber with liquid nitrogen immediately prior to the top 4 being fitted and sealed.

During charging of the primary chamber 5 with beverage 20 (or during handling, for example inversion, of the beverage package subsequent to sealing) beverage from the primary chamber enters the capilliary tube 15 through its upper end 17 and flows through the capilliary bore 15A into the secondary chamber 10 (as indicated at 5A) so that when the contents of the sealed container are in equilibrium a secondary headspace 22 is formed within the secondary chamber 10 containing gas at a pressure greater than atmospheric.

When the sealed package is opened, for example by a ring pull (not shown) in the top 4 to dispense the beer 20, the primary headspace 21 is opened to atmospheric pressure and rapidly de-pressurises. As a consequence a pressure differential is developed whereby the pressure of gas in the secondary headspace 22 exceeds the pressure in the headspace 21. This causes the beer 5A in the secondary chamber 10 to be displaced into the bottom end 16 of the tube to displace beer from the capilliary bore 15A by way of its upper end 17 directly into the headspace 21 and froth or foam to develop as gas is liberated from the beer. It will be noted that the bottom end 16 of the tube 15 and/or the boss 13 opposes and projects into a small recess 23 in the bottom wall 9 of the hollow body 7. This recess 23 conveniently serves as a sump within which an insignificant volume of beer may be retained (following ejection of the beer 5A from the secondary chamber into the headspace of the primary chamber) to minimise wastage of beer within the insert 6.

The upper end 17 of the tube 15 communicates directly with the headspace 21 when the container is opened so that froth which develops as the beer emerges from the tube 15 will float on the beverage in the primary headspace 21. The tube 15 therefore provides an isolating effect to the gas evolution which is initiated from the beer when the container is opened and a considerable proportion of the volume of the beer within the container will retain gas, particularly carbon dioxide, in solution. Therefore when the beer is poured from the container into a drinking glass shortly after opening the can, the froth developed by the evolution of gas from part only of the beverage may provide a desirable head on the beer in the glass. However adequate gas can be maintained in solution in the beer in the glass for such gas to evolve gradually and naturally and present a slight effervescent effect or "sparkle" to the body of the beer—this is considered most desirable for aesthetic quality in lager or light beer and may also enhance the flavor characteristics and mouth feel of the beer.

Gas in solution is liberated from the beer for the purpose of froth development by subjecting the beer in the tube 15 to a cavitation effect as that beer is displaced (as a result of the pressure differential caused by opening of the container) through a restriction provided by the relatively small diameter bore of the capilliary tube 15.

In a typical example the primary chamber 5 may accommodate, say, 440 milliliters of the beer to form a primary headspace 21 of 5% to 15% of the capacity of the container 1. In the sealed package the primary headspace 21 may be pressurised with nitrogen gas, typically to a pressure in the range of 1.5 to 3 atmospheres. The secondary chamber 10 may have a volume of 16 milliliters and the pipe 15 a bore diameter in the range of 0.2 to 3.0 millimetres.

When the package is opened it will be apparent that fluid comprising foam, beer and/or gas ejected from the tube 15 will be jetted from the upper end of the tube into the headspace 21. By positioning the upper end 17 of the tube adjacent to the side wall 3 of the container, preferably so that the tube is directed towards the side wall, the possibility is alleviated of beverage or foam being jetted from the tube through the aperture which is formed by opening the top 4.

Figure 2:
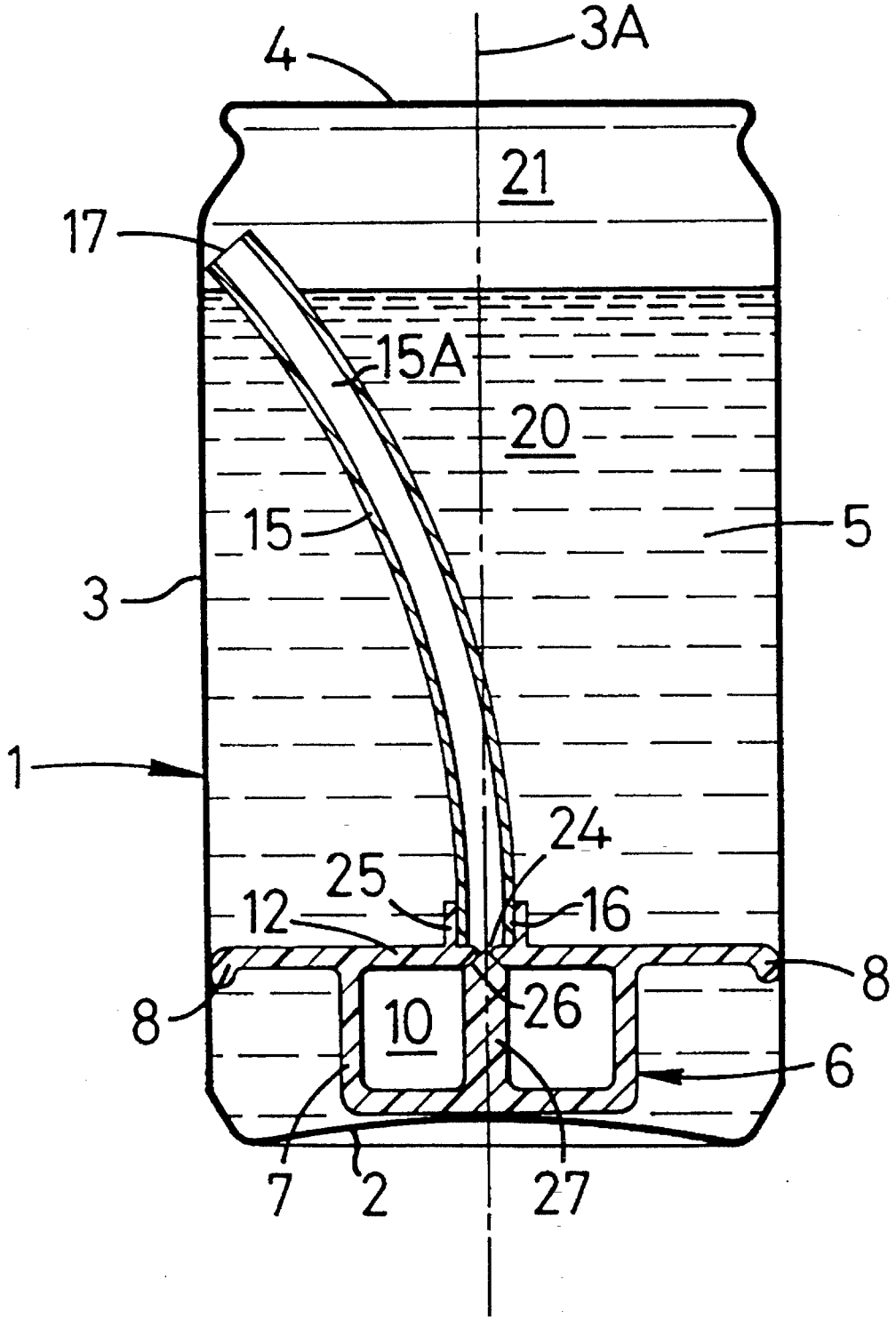
FIG. 2 shows a section through the second embodiment of the package in which a capilliary is fitted in a socket seating of a port in an insert forming the secondary chamber from which gas is ejected.

In the embodiment of FIG. 2 the insert 6 as fitted to the bottom of the primary chamber 5 has its secondary chamber 10 sealed and containing gas, typically nitrogen gas, at a pressure greater than atmospheric. The top wall 12 of the drum has a port 24 located within a cylindrical tubular socket 25 formed integral with the wall 12 and projecting upwardly into the primary chamber co-axial with the axis 3A. The port 24 is closed to seal the secondary chamber 10 by a nose 26 of a peg 27 in the secondary chamber. The peg 27 is formed integral with the bottom wall 9 of the insert drum 7. The capilliary tube 15 is fitted to the insert by displacing its lower end 16 along the axis 3A in the primary chamber for that lower end to be received as a sealing press fit in the socket 25. After fitting the tube 15, the primary chamber 5 is charged with beer 20 and the top 4 fitted to seal the container and pressurise the primary headspace 21. Similarly to the first embodiment the upper end 17 of the capilliary bore 15A opens into the headspace 21 and it is ensured that the bore 15A contains beverage. The sealed package is now processed to ensure that when the top 4 is opened to dispense the beverage, gas from the secondary chamber 4 will be directed automatically through the port 24 into the capilliary bore of the tube 15 in response to the pressure differential that is developed between atmospheric pressure in the primary headspace 21 and the greater pressure in the secondary chamber 10. In a known form of insert having an initially sealed secondary chamber, the aforementioned processing comprises heating the plastics of the insert, for example during pasteurisation of the beer in the sealed package, whereby the characteristics of the insert change to the extent that the nose 26 co-operates with the port 24 and the top wall 12 to form a non-return valve which is responsive to the aforementioned pressure differential. The non-return valve presented by the nose 26 will normally restrain beer from entering the secondary chamber 10 through the port 24. On opening of the container and with the beer in the tube 15, the top wall 12 flexes in response to the pressure differential that is developed to open the port 24 from the nose 26; as a result gas under pressure from the secondary chamber 10 is directed through the port 24 into the bottom end 16 of the capilliary bore to displace beer from the tube 15 directly into the headspace 21 and therefore subject the so-displaced beer to cavitation as it is displaced through the restriction of the capilliary bore to liberate gas in solution from the beer and develop a froth in the primary headspace 21.

We claim:

1. A beverage package comprising a sealed container with a base and a side wall upstanding from the base carrying an openable top; the sealed container having a primary chamber containing beverage having gas in solution therewith and forming a primary headspace comprising gas at a pressure greater than atmospheric; froth developing means comprising an assembly of a secondary chamber and a tube, the secondary chamber containing gas at a pressure greater than atmospheric and having an outlet port in the primary chamber remote from said side wall, said tube having one open end thereof fitted in sealed communication with said outlet port and extending upwardly from said outlet port within the beverage of the primary chamber to locate a second open end of the tube nearer to the openable top than to said outlet port; said froth developing means being arranged so that when said openable top is opened to open the primary headspace to atmosphere, said opening creates a pressure differential which causes pressure from gas in the secondary chamber to eject from said second open end of the tube at least one of gas, beverage and froth and said ejection causes froth resulting from gas liberated from solution in the beverage to develop in the primary headspace, and wherein said tube is pre-curved over its longitudinal extent between said one and second open ends thereof to locate said second open end adjacent to said side wall for said ejection to be effected adjacent to that side wall.

2. A package as claimed in claim 1 in which the upstanding side wall is cylindrical and said outlet port and said one end of the tube fitted thereto are co-axial with the side wall.

3. A package as claimed in claim 1 in which said second end of the tube is open to direct said at least one gas, beverage and froth ejected therefrom towards said side wall.

4. A package as claimed in claim 1 in which said tube contains beverage derived from beverage in the primary chamber.

5. A package as claimed in claim 4 in which with the container in an upstanding condition on its said base, said second end of the tube opens directly into the primary headspace.

6. A package as claimed in claim 4 in which said tube has a capillary bore that provides a restriction and ejection of beverage through said restriction of the tube on said opening of the openable top causes gas to be liberated from solution in the beverage in the tube for froth development.

7. A package as claimed in claim 4 in which a restriction is provided in said secondary chamber through which at least one of gas and beverage in the secondary chamber is ejected into said beverage in the tube on said opening of the openable top and said ejection causes gas to be liberated from solution in the beverage in the tube for froth development as at least one of froth and beverage is ejected from the second end of the tube.

8. A package as claimed in claim 1 in which the secondary chamber is provided within an insert that is located and retained in the primary chamber.

9. A package as claimed in claim 1 in which the secondary chamber has a non-return valve which is responsive to said pressure differential to direct gas under pressure from the secondary chamber through said outlet port.

* * * * *